US006426729B2

(12) United States Patent
Yoshida et al.

(10) Patent No.: US 6,426,729 B2
(45) Date of Patent: Jul. 30, 2002

(54) CONDUCTIVE TRANSMISSION LINE WAVEGUIDE CONVERTER, MICROWAVE RECEPTION CONVERTER AND SATELLITE BROADCAST RECEPTION ANTENNA

(75) Inventors: Yoshikazu Yoshida, Tokyo; Katsunori Honma, Chiba, both of (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 09/782,688

(22) Filed: Feb. 13, 2001

(30) Foreign Application Priority Data

Feb. 14, 2000 (JP) ..... 2000-034465

(51) Int. Cl.[7] ..... H01Q 13/00

(52) U.S. Cl. ..... 343/786; 343/772; 343/775; 333/21 A

(58) Field of Search ..... 343/756, 772, 343/775, 779, 781 R, 781 P, 786; 333/21 A, 26, 126; H01Q 13/00

(56) References Cited

U.S. PATENT DOCUMENTS

| | | | | |
|---|---|---|---|---|
| 5,043,683 A | * | 8/1991 | Howard | 333/21 A |
| 5,245,353 A | | 9/1993 | Gould | 343/786 |
| 6,041,219 A | * | 3/2000 | Peterson | 455/81 |
| 6,043,789 A | * | 3/2000 | Suzuki et al. | 343/786 |
| 6,168,465 B1 | * | 1/2001 | Hirota | 439/579 |

FOREIGN PATENT DOCUMENTS

| | | |
|---|---|---|
| EP | 0 757 400 | 2/1997 |
| EP | 0 853 348 | 7/1998 |
| JP | 63 125001 | 5/1988 |

OTHER PUBLICATIONS

Patent Abstracts of Japan vol. 012, No. 379 (E–667), Oct. 11, 1988 & JP 63 125001 A (Shimada Phys & Chem Ind Co Ltd), May 28, 1988.

* cited by examiner

*Primary Examiner*—Tho Phan
(74) *Attorney, Agent, or Firm*—Frommer Lawrence & Haug LLP; William S. Frommer; Dennis M. Smid

(57) ABSTRACT

A conductive-transmission-line waveguide converter comprising a waveguide for transmitting an electromagnetic wave, a wiring board brought into contact with a side of the waveguide opposite to a side of the waveguide for inputting an electromagnetic wave, being oriented perpendicularly to a longitudinal axis of the waveguide, a first probe provided in an area on the wiring board inside the waveguide for taking in a first linearly polarized wave, and a second probe provided in an area on the wiring board inside the waveguide for taking in a second linearly polarized wave perpendicular to the first linearly polarized wave, wherein the first probe and the second probe are respectively created along mutually perpendicular first and second axis lines, which both pass through a cross point of the wiring board and the longitudinal axis of the waveguide, and a first center line passing through the middle of each transversal line segment of the first probe is shifted from the first axis line and a second center line passing through the middle of each transversal line segment of the second probe is shifted from the second axis line in such a way that, on the wiring board, the first probe is farther separated away from the second probe.

6 Claims, 10 Drawing Sheets

CROSS-POLARIZATION CHARACTERISTICS OF PROBE P1a FOR HORIZONTALLY POLARIZED WAVES

CROSS-POLARIZATION CHARACTERISTICS OF PROBE P2a FOR VERTICALLY POLARIZED WAVES

CONDUCTIVE TRANSMISSION LINE WAVEGUIDE CONVERTER, MICROWAVE RECEPTION CONVERTER AND SATELLITE BROADCAST RECEPTION ANTENNA

BACKGROUND OF THE INVENTION

The present invention relates to a conductive-transmission-line waveguide converter, a microwave reception converter and a satellite-broadcast reception antenna, which are well suitable for reception of a broadcast transmitted as a cross-polarized wave modulated by broadcasted signals of a group of channels having horizontally polarized and vertically polarized waves different from each other such as a CS broadcast and an Astra satellite broadcast of Europe.

A CS broadcast and an Astra satellite broadcast of Europe are each a satellite broadcast using a cross-polarized wave modulated by signals of a group of broadcasting channels with horizontally polarized and vertically polarized waves different from each other.

Comprising a parabola-shaped reflecting mirror and a converter unit, a satellite-broadcasting reception antenna is also referred to as simply a parabola antenna. The converter unit is also referred to as a microwave reception converter. In a parabola antenna for receiving such a cross-polarized wave, the parabola-shaped reflecting mirror reflects a wave transmitted by a satellite to a converter unit. In the converter unit, the reflected wave is introduced into a waveguide by way of a horn-like portion. A polarized-wave splitter splits the wave led to the inside of the waveguide into horizontally-polarized-wave and vertically-polarized-wave components. The horizontally-polarized-wave and vertically-polarized-wave components are each subjected to frequency down conversion in a down converter for producing signals having respective frequencies predetermined for a group of channels. The signals resulting from the frequency down conversion are then supplied to a television tuner.

In the case of the satellite-broadcasting reception antenna including a polarized-wave splitter for splitting a cross-polarized wave into horizontally-polarized-wave and vertically-polarized-wave components, however, the polarized-wave splitter must be provided at a location in the middle of an electromagnetic-wave transmission route inside the waveguide. Thus, the length of the waveguide needs to be increased in the longitudinal direction. As a result, there is raised a problem of a large size. In addition, since a component dedicated to serve as a probe for taking in a horizontally polarized wave is required separately from a component dedicated to serve as a probe for taking in a vertically polarized wave, there is also raised a problem of a rising manufacturing cost.

As a conventional conductive-transmission-line waveguide converter employed in the converter unit, there has been proposed a conductive-transmission-line waveguide converter wherein a conversion unit of a microstrip line is provided inside a waveguide to separate and take in horizontally-polarized-wave and vertically-polarized-wave components from an electromagnetic wave transmitted as a cross-polarized wave.

FIG. 1 is a diagram showing a cross section of the conventional conductive-transmission-line waveguide converter. As shown in the figure, in this conductive-transmission-line waveguide converter, on one side of the longitudinal direction of a cylindrical waveguide 1, a feed horn 2 is provided. On the other side of the longitudinal direction of the cylindrical waveguide 1, a wiring board 3 is provided, being oriented in a direction perpendicular to the longitudinal direction of the waveguide 1. The wiring board 3 is typically a planar board made of a dielectric such as Teflon or the like. The wiring board 3 is provided in such a way that a portion thereof is located on a transmission path of an electromagnetic wave inside the waveguide 1. The feed horn 2 is veiled with a protection cover 4 to prevent dust or the like from entering the inside of the waveguide 1. The wiring board 3 is accommodated in a shield case 5.

Let the surface of the wiring board 3 on the side of the feed horn 2 be the front surface. In this case, on the back-surface side of the wiring board 3, an earth conductor is provided for forming a circuit implemented by a microstrip line. A probe unit 7 is created in an area on of the front surface of the wiring board 3 facing the internal space of the waveguide 1. The probe unit 7 is used for separating horizontally-polarized-wave and vertically-polarized-wave components from an eletromagnetic wave propagating inside the waveguide 1 and taking in the separated wave components.

Broadcasting-channel signals represented by the horizontally polarized and vertically polarized waves taken in by the probe unit 7 are converted into signals having respective frequencies predetermined for a group of channels by a down-converter circuit 8 created on the front-surface of the wiring board 3. The signals with the predetermined frequencies are supplied to a television tuner by way of a connector 6.

FIG. 2 is an explanatory diagram showing the probe unit 7 formed on the front surface of the wiring board 3. To put it in detail, in an area on the front surface of the wiring board 3, an earth conductor 3*c* is created. The area is an area in contact with the edge surface of the waveguide 1. In addition, 2 conductor lines 3*a* and 3*b* with all but equal widths are created on the wiring board 3 along axis lines Lx and Ly, which both pass through a cross point O of the wiring board 3 and the longitudinal axis of the waveguide 1, being orientated perpendicularly to each other.

Thus, an end portion of the conductor line 3*a* and an end portion of the conductor line 3*b* are placed on the wiring board 3 in the internal space of the waveguide 1. As shown in FIG. 2, the lengths of the end portion of the conductor line 3*a* and the end portion of the conductor line 3*b* on the wiring board 3 inside the waveguide 1 are slightly smaller than the inner radius of the waveguide 1. The end portion of the conductor line 3*a* and the end portion of the conductor line 3*b* on the wiring board 3 inside the waveguide 1 are used respectively as a probe P1 for taking in a horizontally polarized wave and a probe P2 for taking in a vertically polarized wave.

As shown in FIG. 2, the center line of the probe P1 on the conductor line 3*a* coincides with the axis line Lx and the center line of the probe P2 on the conductor line 3*b* coincides with the axis line Ly. The center line of the probe P1 is a line passing through the middle of each transversal line segment of the probe P1. By the same token, the center line of the probe P2 is a line passing through the middle of each transversal line segment of the probe P2. The probes P1 and P2 are laid out in such an arrangement that a horizontally polarized wave and a vertically polarized wave are taken in with a highest degree of efficiency.

In the conductive-transmission-line waveguide converter explained above by referring to FIGS. 1 and 2, 2 probes, that is, a horizontal probe and a vertical probe, can be formed on the same planar wiring board. Thus, the conductive-transmission-line waveguide converter offers a merit of a small size and a low manufacturing cost in comparison with a converter wherein a polarized-wave splitter is provided at a location in the middle of an electromagnetic-wave transmission route inside the waveguide for splitting a cross-polarized wave into horizontally polarized-wave and vertically polarized wave components.

Since the probe P1 for taking in a horizontally polarized wave and the probe P2 for taking in a vertically polarized wave are placed on the same planar wiring board, however, there is a tendency to a difficulty to obtain a good cross-polarization characteristic.

SUMMARY OF THE INVENTION

It is thus an object of the present invention addressing the problem described above to provide a conductive-transmission-line waveguide converter that has 2 probes placed on the same planar wiring board and provides good cross-polarization characteristics wherein one of the 2 probes is used for taking in a horizontally polarized wave and the other probe is used for taking in a vertically polarized wave.

In order to solve the problem described above, according to a first aspect of the present invention, there is provided a conductive-transmission-line waveguide converter including a waveguide for transmitting an electromagnetic wave, a wiring board brought into contact with a side of the waveguide opposite to a side of the waveguide for inputting an electromagnetic wave, being oriented perpendicularly to a longitudinal axis of the waveguide, a first probe provided in an area on the wiring board inside the waveguide for taking in a first linearly polarized wave, and a second probe provided in an area on the wiring board inside the waveguide for taking in a second linearly polarized wave perpendicular to the first linearly polarized wave, wherein the first probe and the second probe are created along mutually perpendicular first and second axis lines respectively, which both pass through a cross point of the wiring board and the longitudinal axis of the waveguide, and a first center line passing through the middle of each transversal line segment of the first probe is shifted from the first axis line and a second center line passing through the middle of each transversal line segment of the second probe is shifted from the second axis line in such a way that, on the wiring board, the first probe is farther separated away from the second probe.

According to a second aspect of the present invention, there is provided a microwave reception converter including a waveguide for transmitting an electromagnetic wave, a wiring board brought into contact with a side of the waveguide opposite to a side of the waveguide for inputting an electromagnetic wave, being oriented perpendicularly to a longitudinal axis of the waveguide, a first probe provided in an area on the wiring board inside the waveguide for taking in a first linearly polarized wave, a second probe provided in an area on the wiring board inside the waveguide for taking in a second linearly polarized wave perpendicular to the first linearly polarized wave, a down-converter circuit for down-converting the frequency of a signal representing the first linearly polarized wave taken in by the first probe or a signal representing the second linearly polarized wave taken in by the second probe into a predetermined frequency band, a first amplifier for amplifying a signal representing the first linearly polarized wave taken in by the first probe and executing control to turn on and off an operation to output an amplified signal obtained as a result of amplification of the signal to the down-converter circuit, and a second amplifier for amplifying a signal representing the second linearly polarized wave taken in by the second probe and executing control to turn on and off an operation to output an amplified signal obtained as a result of amplification of the signal to the down-converter circuit, wherein the first probe and the second probe are respectively created along mutually perpendicular first and second axis lines, which both pass through a cross point of the wiring board and the longitudinal axis of the waveguide, and a first center line passing through the middle of each transversal line segment of the first probe is shifted from the first axis line and a second center line passing through the middle of each transversal line segment of the second probe is shifted from the second axis line in such a way that, on the wiring board, the first probe is farther separated away from the second probe.

According to a third aspect of the present invention, there is provided a satellite-broadcasting reception antenna including a reflecting mirror for reflecting an electromagnetic wave transmitted by a satellite, and a microwave reception converter which is used for taking in the electromagnetic wave reflected by the reflecting mirror and down-converting the frequency of the electromagnetic wave into a predetermined frequency band and includes a waveguide for transmitting an electromagnetic wave, a wiring board brought into contact with a side of the waveguide opposite to a side of the waveguide for inputting an electromagnetic wave, being oriented perpendicularly to a longitudinal axis of the waveguide, a first probe provided in an area on the wiring board inside the waveguide for taking in a first linearly polarized wave, a second probe provided in an area on the wiring board inside the waveguide for taking in a second linearly polarized wave perpendicular to the first linearly polarized wave, a down-converter circuit for down-converting the frequency of a signal representing the first linearly polarized wave taken in by the first probe or a signal representing the second linearly polarized wave taken in by the second probe into a predetermined frequency band, a first amplifier for amplifying a signal representing the first linearly polarized wave taken in by the first probe and executing control to turn on and off an operation to output an amplified signal obtained as a result of amplification of the signal to the down-converter circuit, and a second amplifier for amplifying a signal representing the second linearly polarized wave taken in by the second probe and executing control to turn on and off an operation to output an amplified signal obtained as a result of amplification of the signal to the down-converter circuit, wherein the first probe and the second probe are created along mutually perpendicular first and second axis lines respectively, which both pass through a cross point of the wiring board and the longitudinal axis of the waveguide, and a first center line passing through the middle of each transversal line segment of the first probe is shifted from the first axis line and a second center line passing through the middle of each transversal line segment of the second probe is shifted from the second axis line in such a way that, on the wiring board, the first probe is farther separated away from the second probe.

In the conductive-transmission-line waveguide converter, the microwave reception converter and the satellite-broadcasting reception antenna described above, the first probe and the second probe are respectively created along mutually perpendicular first and second axis lines, which both pass through a cross point of the wiring board and the longitudinal axis of the waveguide, and a first center line passing through the middle of each transversal line segment of the first probe is shifted from the first axis line and a second center line passing through the middle of each transversal line segment of the second probe is shifted from the second axis line in such a way that, on the wiring board, the first probe is farther separated away from the second probe. Thus, the physical distance between the 2 probes each used for taking in a polarized wave increases. As a result, good cross-polarization characteristics can be obtained.

In addition, the inventor of the present invention verified that, even if the first and second center lines are separated from the first and second axis lines respectively by offsets in the configuration, the efficiencies of taking in the first and second linearly polarized waves remain almost unchanged so that, practically, the offsets raise no problem.

The above and other objects, features and advantages of the present invention will become apparent from the following description and the appended claims, taken in conjunction with the accompanying drawings in which like parts or elements denoted by like reference symbols.

PREFERRED EMBODIMENT OF THE INVENTION

A preferred embodiment implementing a conductive-transmission-line waveguide converter, a microwave reception converter employing the conductive-transmission-line waveguide converter and a satellite-broadcast reception antenna employing the microwave reception converter in accordance with the present invention, is explained by referring to accompanying diagrams.

Figure 3:
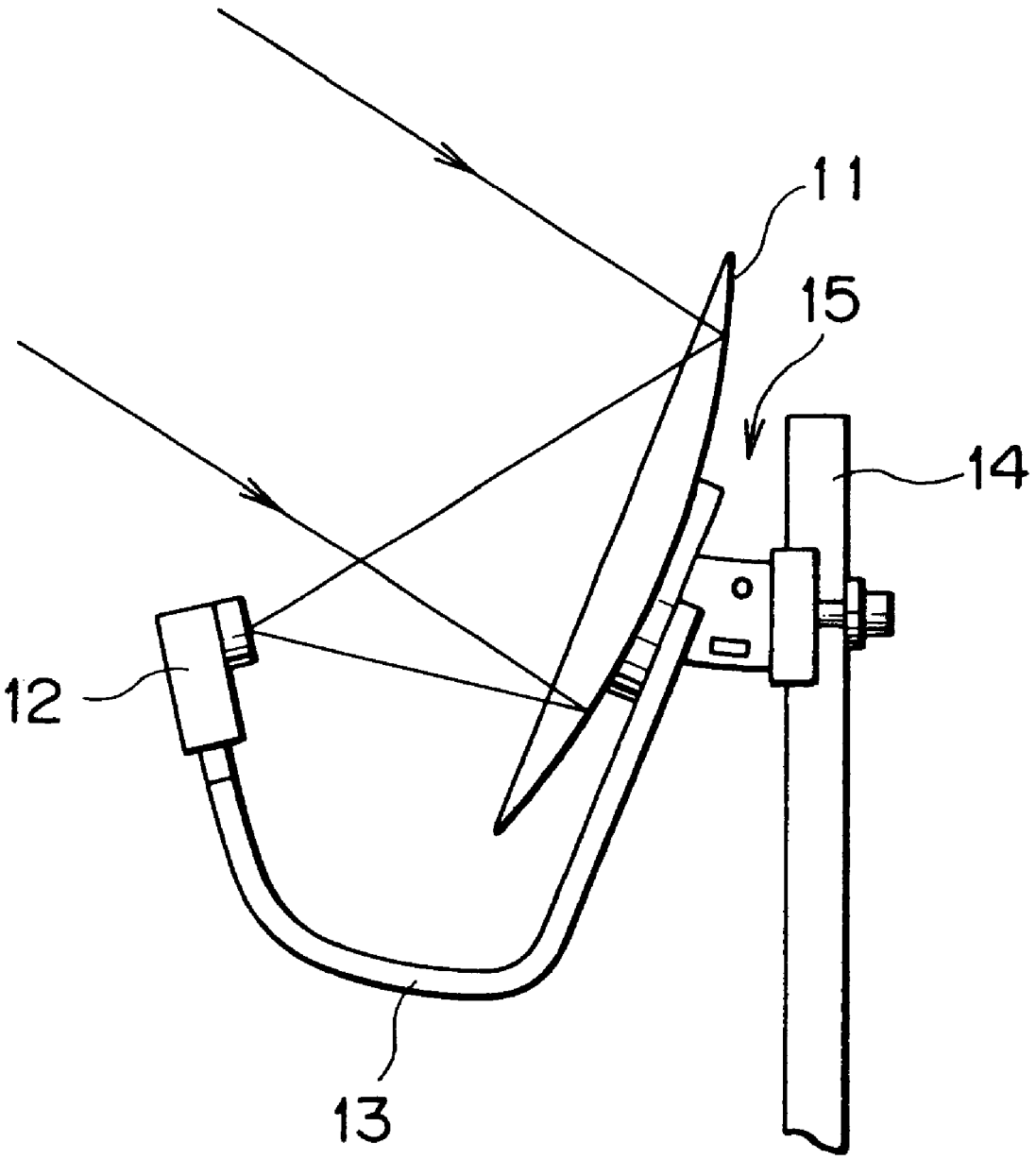
FIG. 3 is an explanatory diagram referred to in a description of a satellite-broadcasting-reception antenna implemented by an embodiment of the present invention.

FIG. 3 is a diagram showing an external appearance of a whole satellite-broadcast reception antenna provided by the embodiment. As shown in the figure, the satellite-broadcast reception antenna comprises a parabola-shaped reflecting mirror 11 and a microwave reception converter unit 12. The microwave reception converter unit 12 is attached to a stay 13, being held at a focal position of the parabola-shaped reflecting mirror 11. The parabola-shaped reflecting mirror 11 is attached to a support pillar 14. A direction adjustment mechanism 15 is used for adjusting the azimuth and the elevation of the parabola-shaped reflecting mirror 11. The satellite-broadcast reception antenna provided by the present invention is used for CS broadcasting. The satellite-broadcast reception antenna is capable of receiving broadcasted waves from 2 stationary satellites located typically at east longitudes of 124 and 128 degrees respectively.

Figure 4:
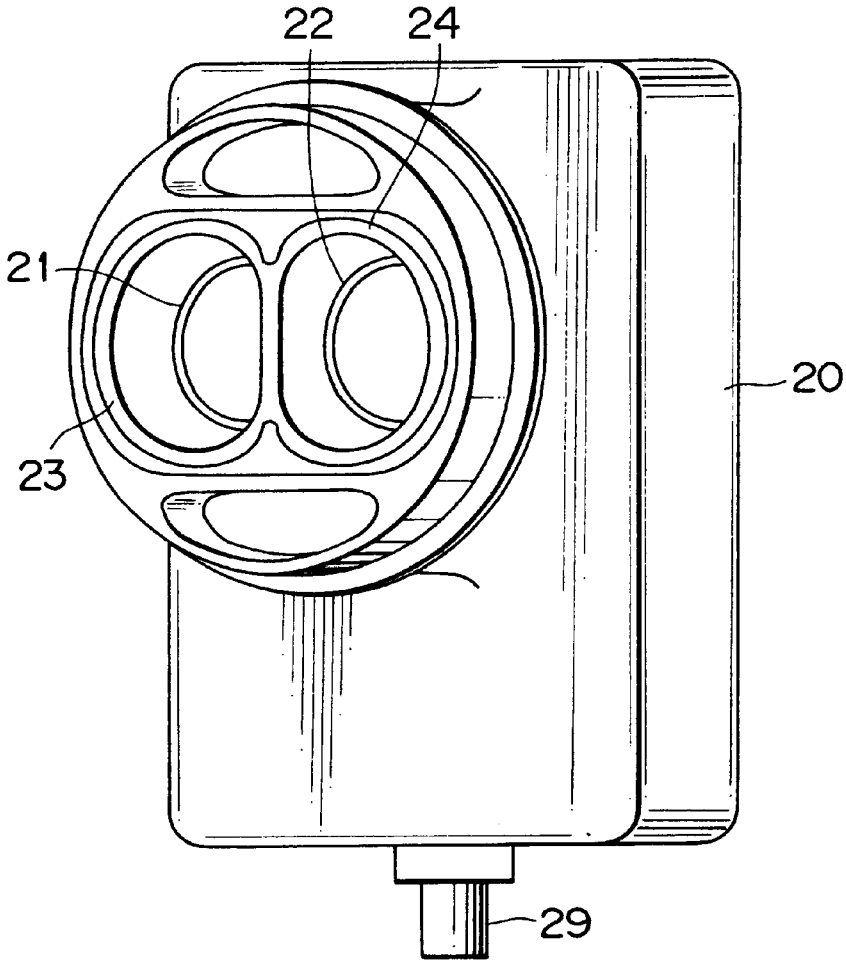
FIG. 4 is a diagram showing an external view of the transmission-conductive-line waveguide converter implemented by the embodiment of the present invention.
Figure 5:
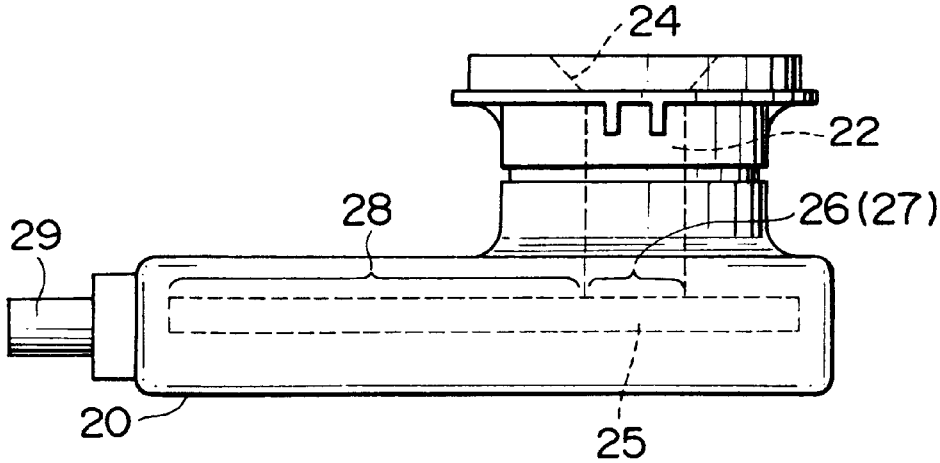
FIG. 5 is a diagram showing a side view of the transmission-conductive-line waveguide converter implemented by the embodiment of the present invention.

FIGS. 4 and 5 are explanatory diagrams referred to in a description of an overview of the microwave reception converter unit 12. To be more specific, FIG. 4 shows an external view of the microwave reception converter unit 12 and FIG. 5 shows a side view thereof. FIGS. 4 and 5 show the microwave reception converter unit 12 with a cover for veiling a feed horn removed.

To put it in detail, the microwave reception converter unit 12 provided by the embodiment has waveguides 21 and 22 for taking in electromagnetic waves of broadcast waves transmitted by the 2 stationary satellites respectively. On the taking-in side of the waveguide 21, a feed horn 23 is provided. In the same way, on the taking-in side of the waveguide 22, a feed horn 24 is provided. On the side longitudinally opposite to the side of the 2 waveguides 21 and 22 on which the feed horns 23 and 24 are installed respectively, a wiring board 25 is provided. The wiring board 25 is a planar board made of a dielectric such as Teflon. The wiring board 25 is provided in such a way that the surface thereof is orientated perpendicularly to the longitudinal directions of the waveguides 21 and 22, and the surface of the wiring board 25 is brought into contact with the edge surfaces of the waveguides 21 and 22. The wiring board 25 is accommodated in a shield case 20.

Let the surface of the wiring board 25 on the side of the waveguides 21 and 22 be a front surface. In this case, on the back-surface side of the wiring board 25, an earth conductor is provided for forming a circuit implemented by a microstrip line. Probe units 26 and 27 are created in areas of the front surface of the wiring board 25 facing the internal spaces of the waveguides 21 and 22 respectively. The probe unit 26 is used for separating horizontally-polarized-wave and vertically-polarized-wave components from an eletromagnetic wave propagating inside the waveguide 21 and taking in the separated wave components. In the same way, the probe unit 27 is used for separating horizontally-polarized-wave and vertically-polarized-wave components from an eletromagnetic wave propagating inside the waveguide 22 and taking in the separated wave components. The probe units 26 and 27 will be described in more detail later.

Then, broadcasting-channel signals represented by horizontally polarized and vertically polarized waves taken in by the probe units 26 and 27 are amplified by an FET amplifier created on the front-surface of the wiring board 25 before being converted into signals having respective predetermined frequencies by a down-converter circuit 28. The signals with the predetermined frequencies are supplied to a reception unit such as a television tuner by way of a connector 29. In this case, the reception unit such as a television tuner generates a control signal to execute switching control on the FET amplifier so as to select only a desired satellite and desired wave signals. In this way, only signals of a selected channel group are converted into signals with predetermined frequencies before being supplied to a reception unit such as a television tuner by way of the connector 29.

Figure 6:
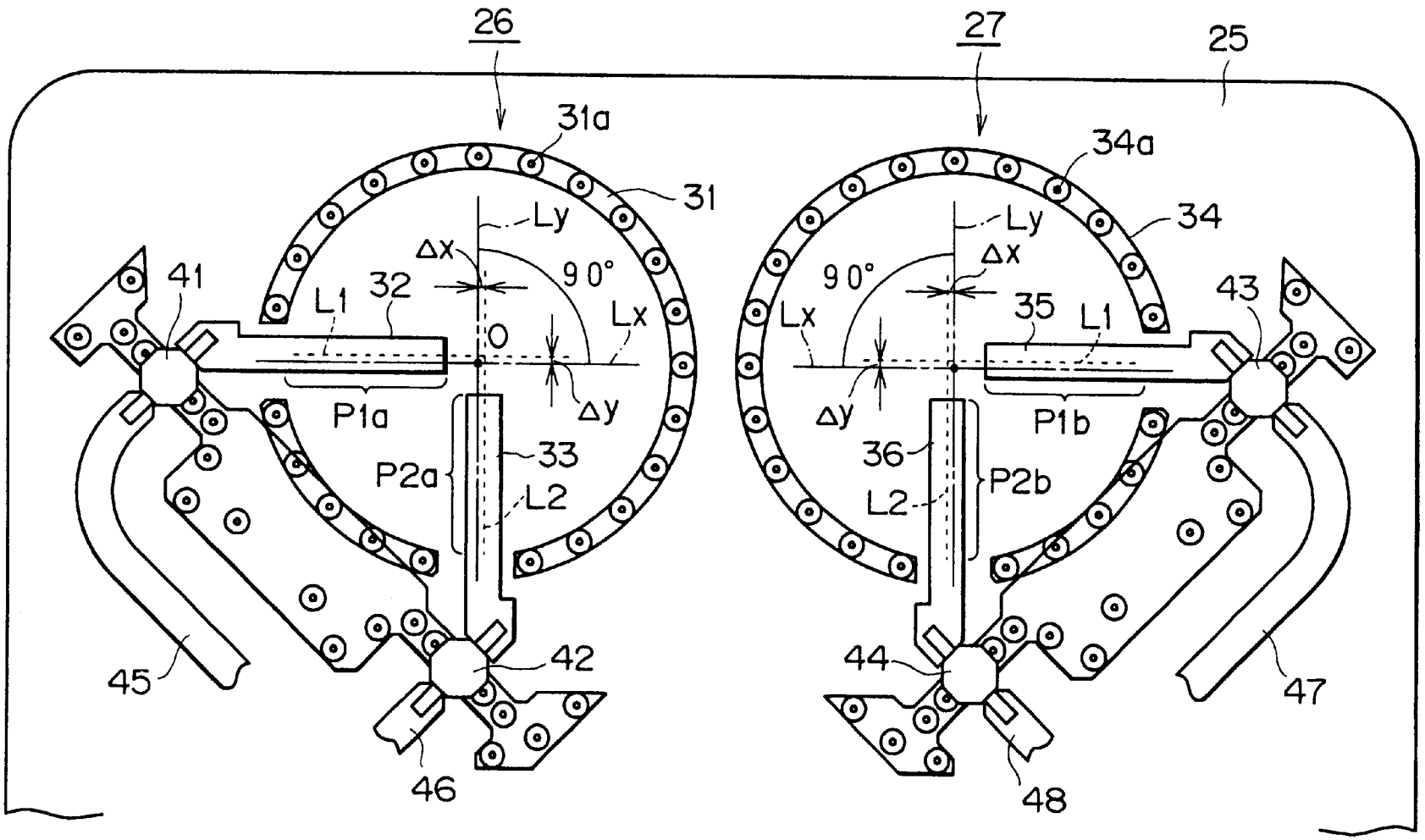
FIG. 6 is a diagram showing main components composing the transmission-conductive-line waveguide converter implemented by the embodiment of the present invention.

FIG. 6 is an explanatory diagram referred to in a description of the aforementioned probe units 26 and 27 created on the front surface of the wiring board 25.

An earth conductor 31 is created in an area on the front surface of the wiring board 25 as a part of the probe unit 26. The area is an area in contact with the edge surface of the waveguide 21. The earth conductor 31 is connected to an earth conductor on the back surface of the board 25 via through holes 31*a*. In addition, 2 conductor lines 32 and 33 with all but equal widths are created on the wiring board 25 along axis lines Lx and Ly, which both pass through a cross point O of the front surface and the longitudinal axis of the waveguide 21 and are perpendicular to each other.

Thus, an end portion of the conductor line 32 and an end portion of the conductor line 33 are placed on the wiring board 25 in the internal space of the waveguide 21. As shown in FIG. 6, the lengths of the end portion of the conductor line 32 and the end portion of the conductor line 33 on the wiring board 25 inside the waveguide 21 are slightly smaller than the inner radius of the waveguide 21. The end portion of the conductor line 32 and the end portion of the conductor line 33 on the wiring board 25 inside the waveguide 21 are used as a probe P1*a* for taking in a horizontally-polarized-wave component of a cross-polarized wave transmitted by a first satellite and a probe P2*a* for taking in a vertically-polarized-wave component of the cross-polarized wave respectively.

In the case of this embodiment, as shown in FIG. 6, the center line L1 of the probe P1*a* on the conductor line 32 does not coincide with the axis line Lx and the center line L2 of the probe P2*a* on the conductor line 33 does not coincide with the axis line Ly either. The center line L1 is a line passing through the middle of each transversal line segment of the probe P1*a*. By the same token, the center line L2 is a line passing through the middle of each transversal line segment of the probe P2*a*. The line center L1 of the probe P1*a* and the center line L2 of the probe P2*a* are shifted from the axis lines Lx and Ly respectively by such an offset that the probes P1*a* and P2*a* are farther separated from each other.

In this embodiment, the center line L1 is oriented in parallel to the axis line Lx and the center line L2 is oriented in parallel to the axis line Ly. That is to say, the offset from the center line L1 to the axis line Lx in the probe P1*a* and the offset from the center line L2 to the axis line Ly in the probe P2*a* are each a distance caused by a parallel shift. The offsets in the probes P1*a* and P2*a* are $\Delta y$ and $\Delta x$ respectively.

In the same way, an earth conductor 34 is created in an area on the front surface of the wiring board 25 as a part of the probe unit 27. The area is an area in contact with the edge surface of the waveguide 22. The earth conductor 34 is connected to an earth conductor on the back surface of the board 25 via through holes 34*a*. In addition, 2conductor lines 35 and 36 with all but equal widths are created on the wiring board 25 along axis lines Lx and Ly, which both pass through a cross point O of the front surface and the longitudinal axis of the waveguide 22 and are perpendicular to each other.

Thus, an end portion of the conductor line 35 and an end portion of the conductor line 36 are placed on the wiring board 25 in the internal space of the waveguide 22. As shown in FIG. 6, the lengths of the end portion of the conductor line 35 and the end portion of the conductor line 36 on the wiring board 25 inside the waveguide 22 are slightly smaller than the inner radius of the waveguide 22. The end portion of the conductor line 35 and the end portion of the conductor line 36 on the wiring board 25 inside the waveguide 22 are used as a probe P1*b* for taking in a horizontally-polarized-wave component of a cross-polarized wave transmitted by a second satellite and a probe P2*b* for taking in a vertically-polarized-wave component of the cross-polarized wave respectively.

Figure 1:
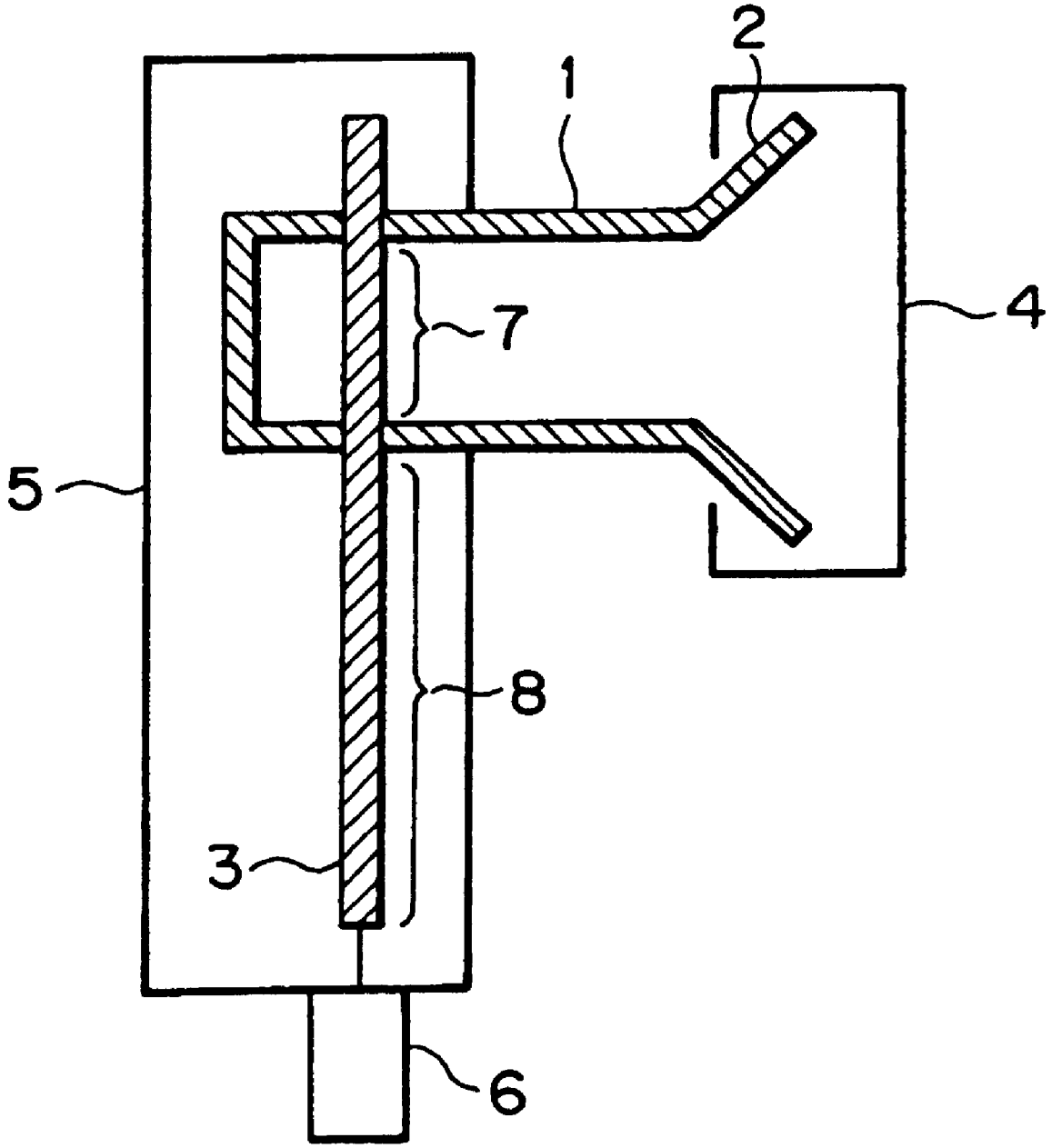
FIG. 1 (PRIOR ART)
FIG. 1 is an explanatory diagram referred to in a description of the conventional microwave reception converter.
Figure 2:
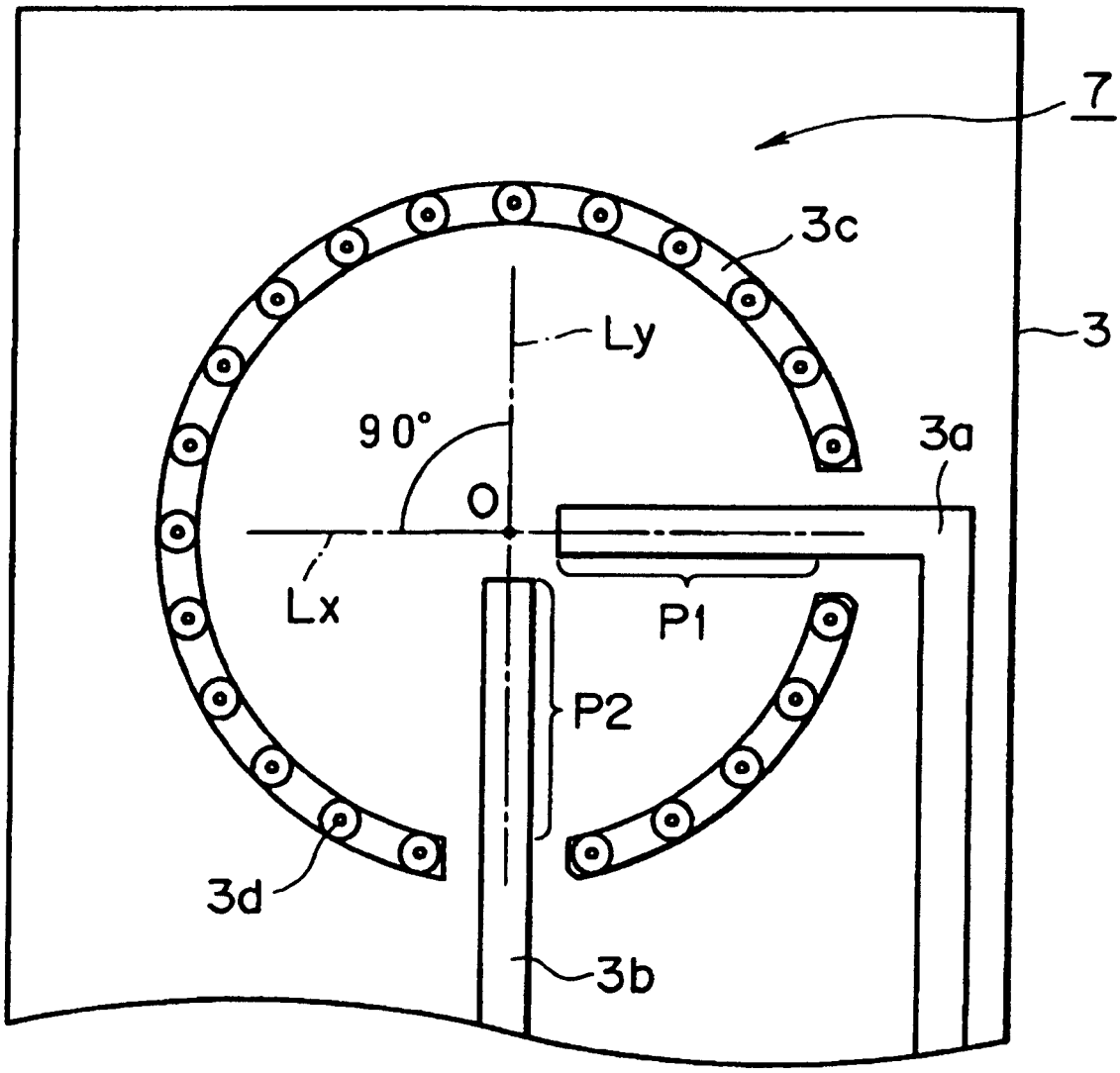
FIG. 2 (PRIOR ART)
FIG. 2 is an explanatory diagram referred to in a description of the conventional microwave reception converter.

In the case of this embodiment, as shown in FIG. 1, the center line L1 of the probe P1*b* on the conductor line 35 does not coincide with the axis line Lx as is the case of the probe P1*a* of the probe unit 26, and the center line L2 of the probe P2*b* on the conductor line 36 does not coincide with the axis line Ly either as is the case of the probe P2*a* of the probe unit 26. The center line L1 is a line passing through the middle of each transversal line segment of the probe P1*b*. By the same token, the center line L2 is a line passing through the middle of each transversal line segment of the probe P2*b*. The line center L1 of the probe P1*b* and the center line L2 of the probe P2*b* are shifted from the axis lines Lx and Ly respectively by such an offset that the probes P1*b* and P2*b* are farther separated from each other. The axis line Lx is oriented in parallel to the center line L1*b* and the axis line Ly is oriented in parallel to the center line L2. That is to say, the offset from the center line L1 to the axis line Lx in the probe P1*b* and the offset from the center line L2 to the axis line Ly in the probe P2*b* are each a distance caused by a parallel shift. The offsets in the probes P1*b* and P2*b* are $\Delta y$ and $\Delta x$ respectively.

In this embodiment, the probe P1*a* provided as a part of the probe unit 26 for taking in a horizontally polarized wave is located on the left side of the internal space of the waveguide 21 while the probe P1*b* provided as a part of the probe unit 27 for taking in a horizontally polarized wave is located on the right side of the internal space of the waveguide 22. By locating the probes P1*a* and P1*b* in this way, inlets of the probes P1*a* and P1*b* for taking in polarized-wave components are separated from each other by as a long distance as possible so that the amount of interference can be reduced.

In the configuration described above, horizontally-polarized-wave components taken in by the probes P1*a* and P1*b* are amplified by FET amplifiers 41 and 43 respectively before being supplied to a converter circuit 28 through microstrip lines 45 and 47 respectively. On the other hand, vertically-polarized-wave components taken in by the probes P2*a* and P2*b* are amplified by FET amplifiers 42 and 44 respectively before being supplied to the converter circuit 28 through the microstrip lines 46 and 48 respectively. The converter circuit 28 converts the frequency of the components into a predetermined frequency band and outputs signals in the frequency band to a television tuner.

In this case, the television tuner or the like generates a control signal to execute switching control on the FET amplifiers 41, 42, 43 and 44 so as to select only a desired satellite and desired polarized-wave components even though this switching control is shown explicitly in none of the figures.

Figure 7:
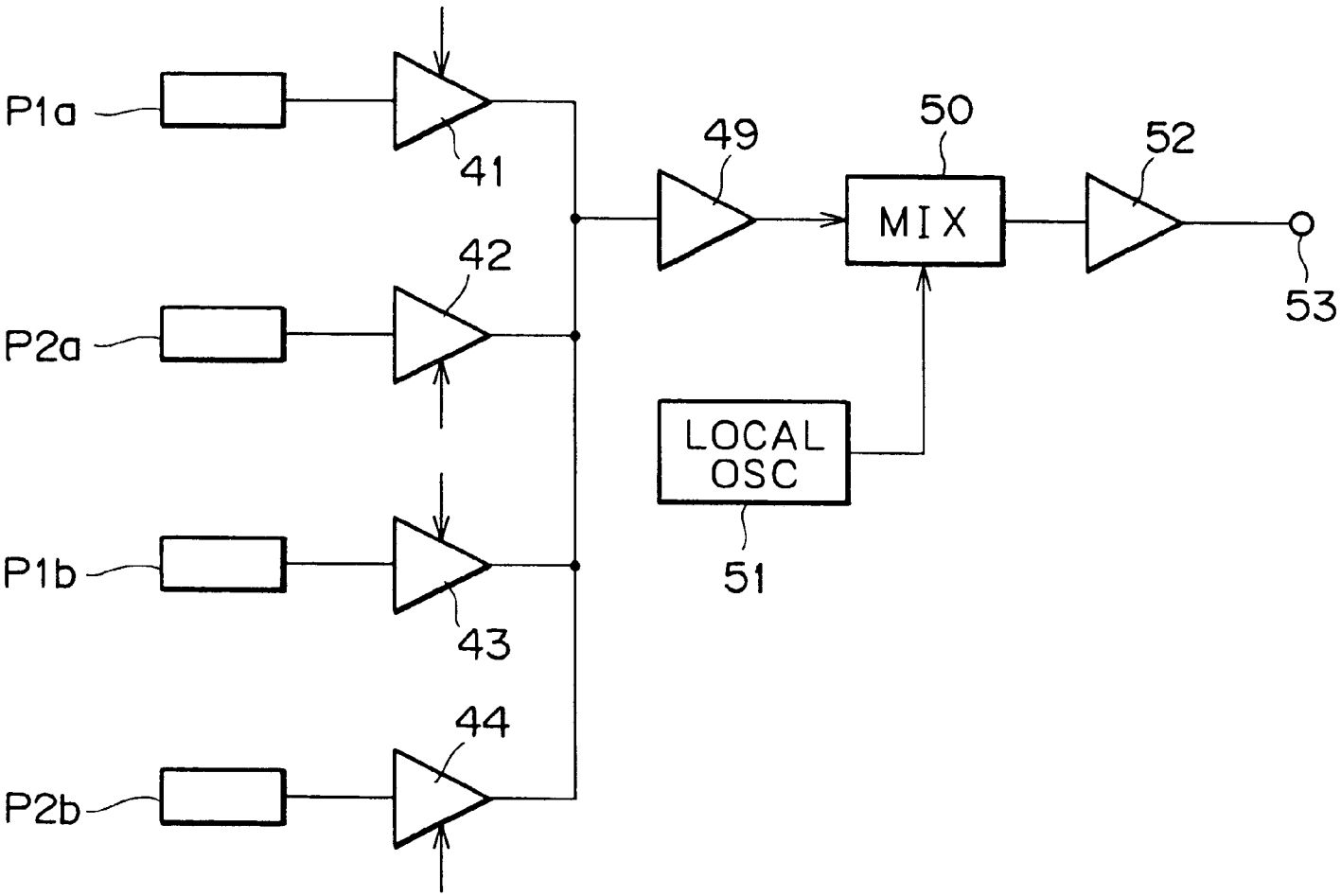
FIG. 7 is a circuit block diagram showing a microwave reception converter implemented by the embodiment of the present invention.

The following description explains a typical configuration of the microwave reception converter starting with the probes P1*a*, P2*a*, P1*b* and P2*b* employed in the embodiment and including a portion of the converter circuit 28 by referring to FIG. 7.

A channel-group's signal representing a horizontally polarized wave transmitted by a first satellite and taken in by the probe P1*a* is supplied to a FET amplifier 49 by way of the FET amplifier 41. In the same way, the channel-group's signal representing a vertically polarized wave transmitted by the first satellite and taken in by the probe P2*a* is supplied to the FET amplifier 49 by way of the FET amplifier 42. By the same token, the channel-group's signal representing a horizontally polarized wave transmitted by the second satellite and taken in by the probe P1*b* is supplied to the FET amplifier 49 by way of the FET amplifier 43. Likewise, the channel-group's signal representing a vertically polarized wave transmitted by the second satellite and taken in by the probe P2*b* is supplied to the FET amplifier 49 by way of the FET amplifier 44.

As described earlier, the FET amplifiers 41 to 44 are turned on and off by their respective control signals in order to select only a satellite transmitting a signal of a broadcasting channel selected by the user and, hence, to select only desired polarized-wave components.

Then, a signal output by the FET amplifier 49 is supplied to a mixer 50 serving as a frequency converter. The mixer 50 multiplies the input signal by an oscillation signal generated by a local oscillator 51 to convert the input signal into an output signal of a predetermined frequency band. The signal of a predetermined frequency band is finally supplied to an output terminal 53 by way of an FET amplifier 52. The output terminal 53 is wired to the connector 29 through which the signal output to the output terminal 53 is supplied to a reception unit such as a television tuner.

Next, cross-polarization characteristics of a satellite-broadcasting reception antenna including a conductive-transmission-line waveguide converter having a configuration described above is explained by comparison of the characteristics with those of a reference conductive-transmission-line waveguide converter.

Figure 8:
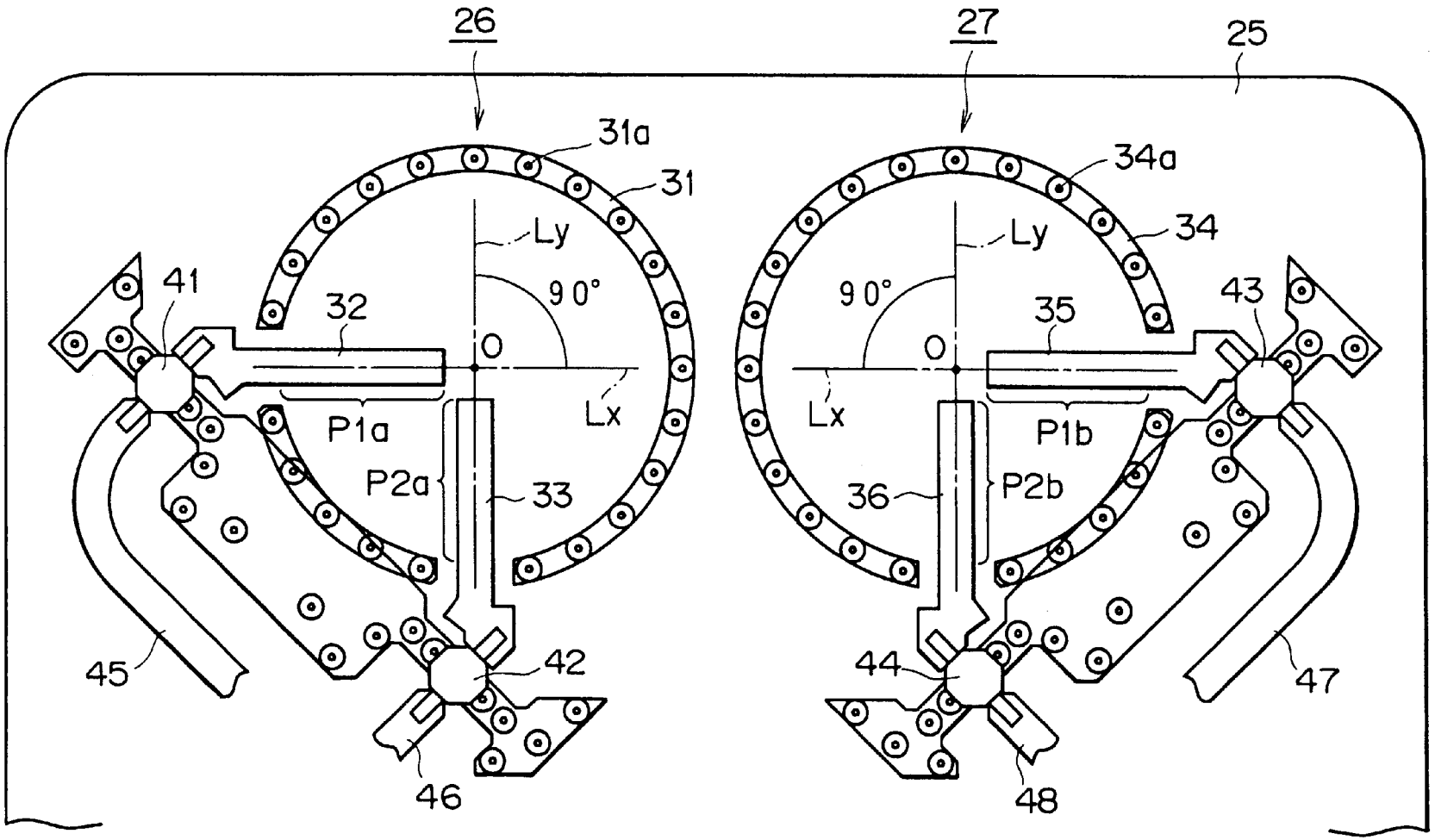
FIG. 8 is a diagram showing main components composing a reference transmission-conductive-line waveguide converter to be compared with the transmission-conductive-line waveguide converter implemented by the embodiment of the present invention.

First of all, the reference conductive-transmission-line waveguide converter is explained. FIG. 8 is a diagram showing the reference conductive-transmission-line waveguide converter. As shown in the figure, the reference conductive-transmission-line waveguide converter comprises counterpart components of those employed in the conductive-transmission-line waveguide converter implemented by the embodiment shown in FIG. 6.

The only difference between the conductive-transmission-line waveguide converters shown in FIGS. 6 and 8 is that, in the case of the reference conductive-transmission-line waveguide converter shown in FIG. 8, the center line L1 of the probe P1*a* and the center line L2 of the probe P2*a* coincide with (or are separated by no offset from) the axis line Lx and the axis line Ly respectively where the center line L1 is a line passing through the middle of each transversal line segment of the probe P1*a* and the center line L2 is a line passing through the middle of each transversal line segment of the probe P2*a* whereas the axis lines Lx and Ly pass through a cross point O of the front surface of the wiring board 25 and the longitudinal axis of the waveguide 21 and are perpendicular to each other. By the same token, the center line L1 of the probe P1*b* and the center line L2 of the probe P2*b* coincide with (or are separated by no offset from) the axis line Lx and the axis line Ly respectively where the center line L1 is a line passing through the middle of each transversal line segment of the probe P1*b* and the center line L2 is a line passing through the middle of each transversal line segment of the probe P2*b* whereas the axis lines Lx and Ly pass through a cross point O of the front surface of the wiring board 25 and the longitudinal axis of the waveguide 22 and are perpendicular to each other.

In a measurement of cross-polarization characteristics described below, the inner radii of the waveguides 21 and 22 are each set at a typical value of about 17 mm whereas the offsets Δx and Δy of the conductive-transmission-line waveguide converter shown in FIG. 1 are each set at 0.2 mm.

Figure 9:
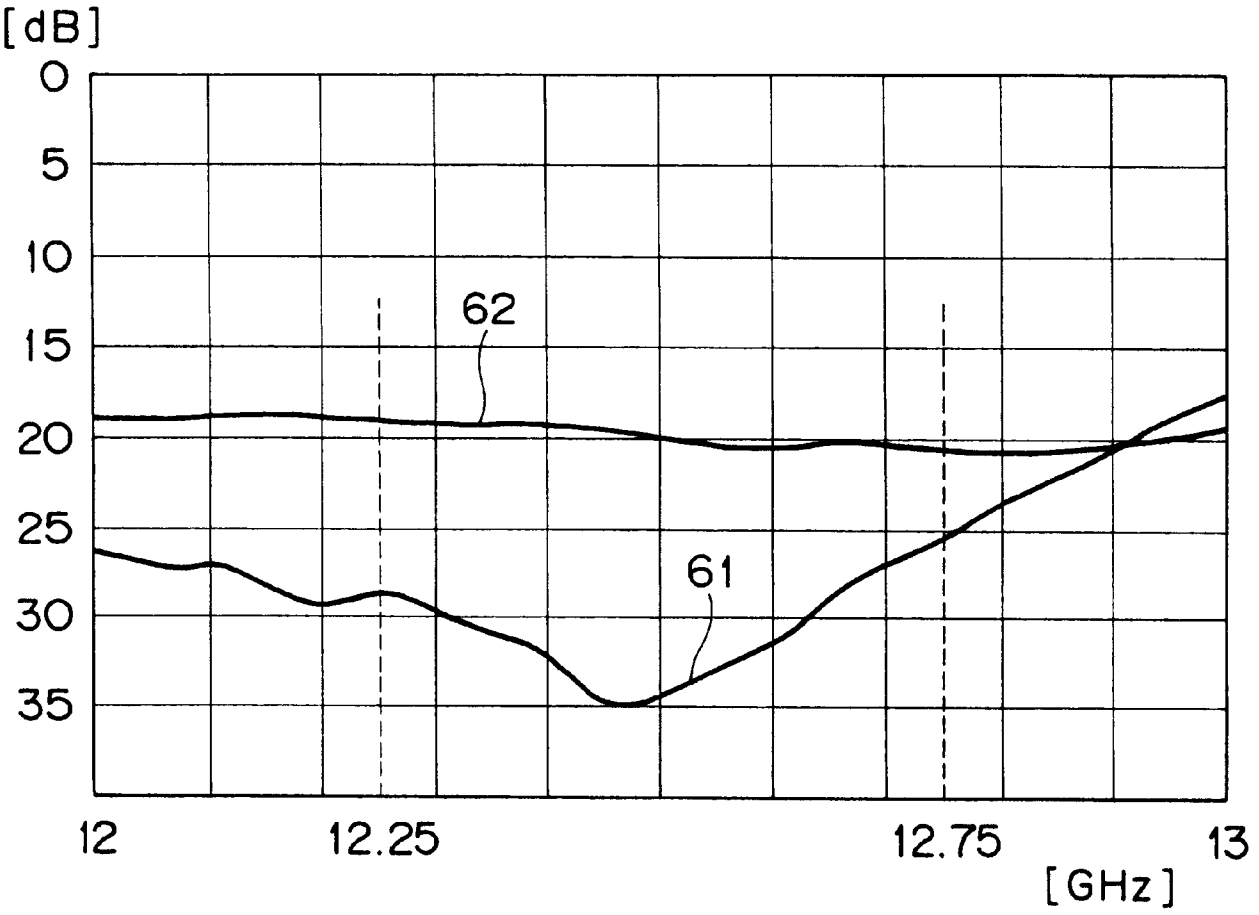
FIG. 9 is a diagram showing cross-polarization characteristics of the reference transmission-conductive-line waveguide converter and the transmission-conductive-line waveguide converter implemented by the embodiment of the present invention.

FIG. 9 is a diagram showing cross-polarization characteristics obtained as a result of measurement for a horizontally polarized wave output by the probe P1*a*. To be more specific, a curve 61 is the cross-polarization characteristic of the conductive-transmission-line waveguide converter implemented by the embodiment shown in FIG. 6 and a curve 62 is the cross-polarization characteristic of the reference conductive-transmission-line waveguide converter shown in FIG. 8.

Figure 10:
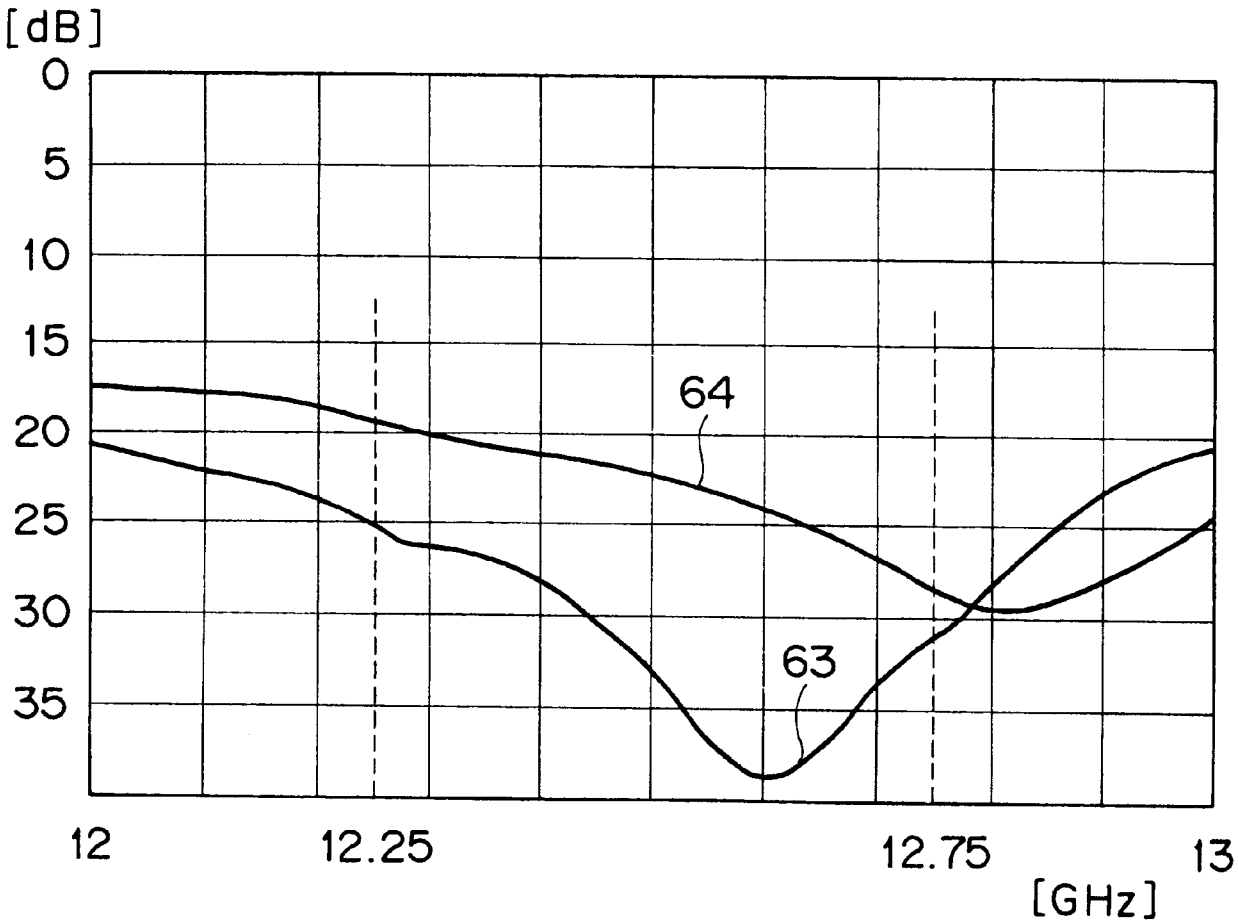
FIG. 10 is a diagram showing cross-polarization characteristics of the reference transmission-conductive-line waveguide converter and the transmission-conductive-line waveguide converter implemented by the embodiment of the present invention.

Similarly, FIG. 10 is a diagram showing cross-polarization characteristics obtained as a result of. measurement for a vertically polarized wave output by the probe P2*a*. To be more specific, a curve 63 is the cross-polarization characteristic of the conductive-transmission-line waveguide converter implemented by the embodiment shown in FIG. 6 and a curve 64 is the cross-polarization characteristic of the reference conductive-transmission-line waveguide converter shown in FIG. 8.

As is obvious from FIGS. 9 and 10, in a frequency band of 12.25 GHz to 12.75 GHz required as an antenna reception band, the conductive-transmission-line waveguide converter implemented by the embodiment exhibits very good cross-polarization characteristics in comparison with the reference conductive-transmission-line waveguide converter.

It should be noted that the efficiency at which the embodiment takes in a horizontally polarized wave and a vertically polarized wave at the same time was also compared with the efficiency at which the reference conductive-transmission-line waveguide converter takes in a horizontally polarized wave and a vertically polarized wave at the same time. A result of the comparison shown in none of the figures indicated no meaningful difference between the embodiment and the reference converter. Thus, the embodiment has been verified to be practically not inferior to the reference converter.

As described above, according to the embodiment, even if 2 probes, that is, a probe for taking in a horizontally polarized wave and a probe for taking in a vertically polarized wave, are provided on a planar wiring board with orientations thereof perpendicular to each other, there is only a small amount of mutual interference between the polarized-wave components, so that it is possible to implement a conductive-transmission-line waveguide converter exhibiting good cross-polarization characteristics.

As described above, in the case of a conductive-transmission-line waveguide converter wherein a center line L1 of a probe P1 and a center line L2 of a probe P2 coincide with axis lines Lx and Ly respectively where the center line L1 is a line passing through the middle of each transversal line segment of the probe P1 and the center line L2 is a line passing through the middle of each transversal line segment of the probe P2 whereas the axis lines Lx and Ly pass through a cross point of a wiring board and the longitudinal axis of a waveguide, it is necessary to increase the widths of the probes P1 and P2 in order to improve the cross-polarization characteristics. However, changing the shape of a probe entails a variation in NF (noise figure) characteristic, and it is difficult to improve both the cross-polarization characteristics and the NF characteristic at the same time.

In the case of a conductive-transmission-line waveguide converter wherein a center line L1 of a probe P1*a* or P1*b* and a center line L2 of a probe P2*a* or P2*b* do not coincide with axis lines Lx and Ly respectively where the center line L1 is a line passing through the middle of each transversal line segment of the probe P1*a* or P1*b* and the center line L2 is a line passing through the middle of each transversal line segment of the probe P2*a* or P2*b* whereas the axis lines Lx and Ly pass through a cross point of a wiring board and the longitudinal axis of a waveguide, on the other hand, the 2 probes, namely, P1*a* or P1*b* and P2*a* or P2*b* are farther separated from each other. Since the physical distance between the 2 probes, namely, P1*a* or P1*b* and P2*a* or P2*b*, increases, the required cross-polarization characteristics can be obtained.

In addition, in the case of the conductive-transmission-line waveguide converter implemented by the embodiment, the width of a conductor line comprising any of 2 probes located perpendicularly to each other can be changed appropriately so that the gap between the 2 probes is not decreased. As s result, the NF characteristic can also be improved as well.

Figure 11:
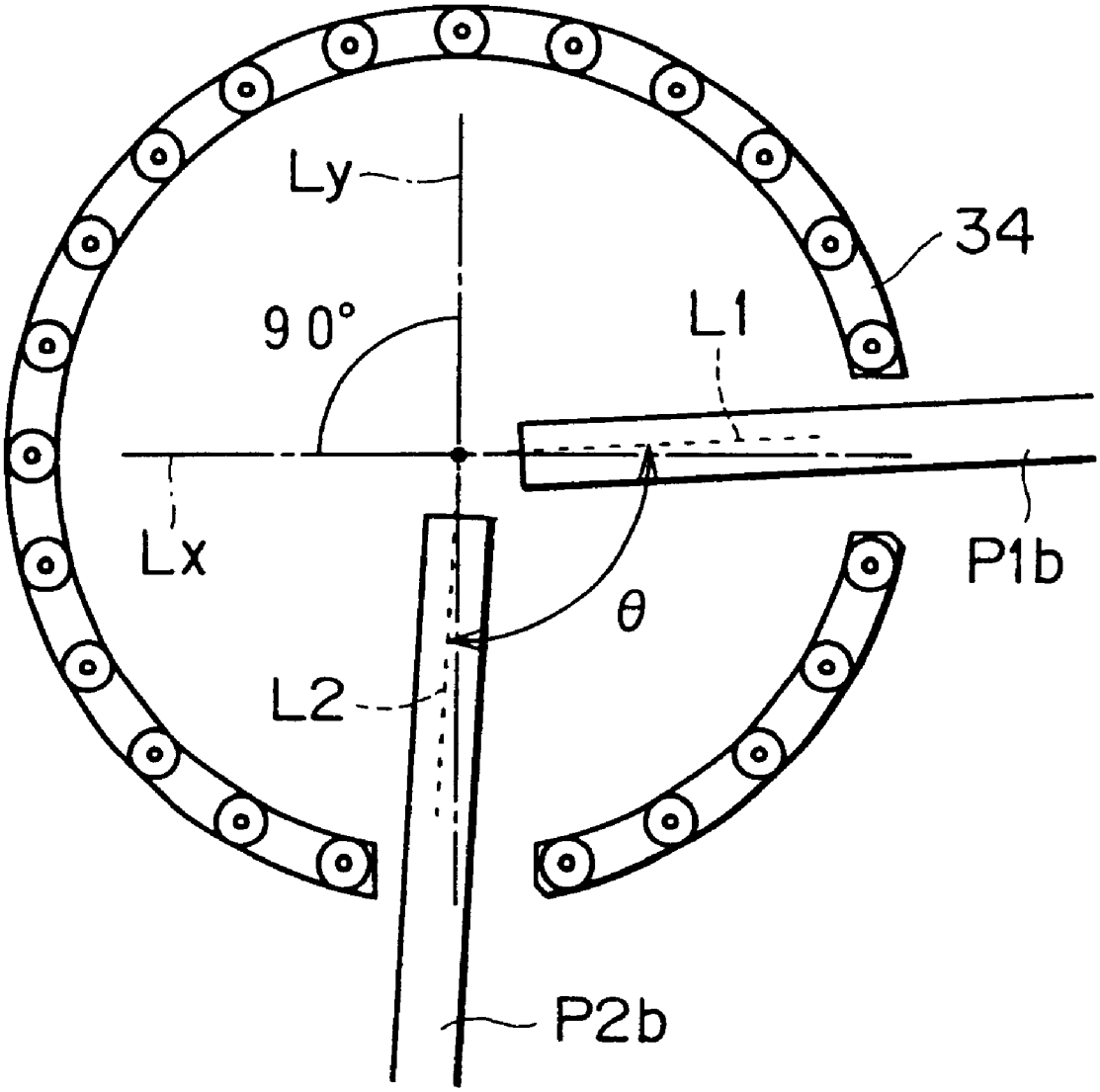
FIG. 11 is a diagram showing main components composing a transmission-conductive-line waveguide converter implemented by another embodiment of the present invention.

In the embodiment described above, by shifting the 2 probes located perpendicularly to each other without changing the orientations of the probes, it is possible to implement a conductive-transmission-line waveguide converter exhibiting good cross-polarization characteristics. In another embodiment, it is possible to increase an angle θ formed by the center line L1 passing through the middle of each transversal line segment of one of the probes and the center line L2 passing through the middle of each transversal line segment of the other probe to a value greater than 90 degrees in order to raise the distance between the probes at the roots as shown in FIG. 11. As a result, the conductive-transmission-line waveguide converter implemented by this other embodiment exhibits very good cross-polarization characteristics in comparison with the reference conductive-transmission-line waveguide converter.

In the embodiments described above, 2 waveguides are used for receiving cross-polarized waves transmitted by 2 satellites respectively. It should be noted that the present invention can of course be applied in exactly the same way to a conductive-transmission-line waveguide converter, a microwave reception converter and a satellite-broadcast reception antenna wherein only 1 waveguide and a pair of probes are employed.

It is needless to say that the present invention can also be applied in exactly the same way to a circular polarized wave of the BS (Broadcasting Satellite) broadcasting and 110° CS broadcasting planned in the future provided that the circular polarized wave is converted into 2 linearly polarized waves perpendicular to each other by using a circular-to-linear wave converter provided typically in a waveguide.

As described above, according to the present invention, even if 2 probes for taking in respectively a first linearly polarized wave and a second linearly polarized wave perpendicular to the first linearly polarized wave are provided on a planar wiring board, being orientated perpendicularly to each other, there is only a small amount of mutual interference between the polarized-wave components, so that it is possible to implement a conductive-transmission-line waveguide converter exhibiting good cross-polarization characteristics.

In addition, the width of a conductor line comprising any of the 2 probes located perpendicularly to each other can be changed appropriately so that the gap between the probes is not decreased. As s result, the NF characteristic can also be improved as well.

While a preferred embodiment of the present invention has been described using specific terms, such description is for illustrative purposes only, and it is to be understood that changes and variations may be made without departing from the spirit or scope of the following claims.

What is claimed is:

1. A conductive-transmission-line waveguide converter comprising:

a waveguide for transmitting an electromagnetic wave;

a wiring board brought into contact with a first side of said waveguide opposite to a second side of said waveguide for inputting an electromagnetic wave, being oriented perpendicularly to a longitudinal axis of said waveguide;

a first probe disposed directly on an area on said wiring board inside said waveguide for taking in a first linearly polarized wave; and a second probe disposed directly on an area on said wiring board inside said waveguide for taking in a second linearly polarized wave perpendicular to said first linearly polarized wave;

wherein:

said first probe and said second probe are respectively created along mutually perpendicular first and second axis lines, which both pass through a cross point of said wiring board and the longitudinal axis of said waveguide; and a first center line passing through the middle of each transversal line segment of said first probe is shifted from said first axis line and a second center line passing through the middle of each transversal line segment of said second probe is shifted from said second axis line in such a way that, on said wiring board, said first probe is farther separated away from said second probe.

2. A conductive-transmission-line waveguide converter according to claim 1 wherein said first and second probes are located on said wiring board in such a way that said first probe includes at least a portion of said first axis line and said second probe includes at least a portion of said second axis line.

3. A conductive-transmission-line waveguide converter according to claim 1 wherein said first and second probes are located on said wiring board in such a way that:

said first center line is oriented in parallel to said first axis line whereas said second center line is oriented in parallel to said second axis line; and said first probe includes said first axis line whereas said second probe includes said second axis line.

4. A conductive-transmission-line waveguide converter according to claim 2 wherein said first and second center lines of said first and second probes respectively form an angle greater than 90 degrees.

5. A microwave reception converter comprising:

a waveguide for transmitting an electromagnetic wave;

a wiring board brought into contact with a first side of said waveguide opposite to a second side of said waveguide for inputting an electromagnetic wave, being oriented perpendicularly to a longitudinal axis of said waveguide;

a first probe provided in an area on said wiring board inside said waveguide for taking in a first linearly polarized wave;

a second probe provided in an area on said wiring board inside said waveguide for taking in a second linearly polarized wave perpendicular to said first linearly polarized wave;

a down-converter circuit for down-converting the frequency of a signal representing said first linearly polarized wave taken in by said first probe or a signal representing said second linearly polarized wave taken in by said second probe into a predetermined frequency band;

a first amplifier for amplifying a signal representing said first linearly polarized wave taken in by said first probe and executing control to turn on and off an operation to output an amplified signal obtained as a result of amplification of said signal to said down-converter circuit; and a second amplifier for amplifying a signal representing said second linearly polarized wave taken in by said second probe and executing control to turn on and off an operation to output an amplified signal obtained as a result of amplification of said signal to said down-converter circuit, wherein:

said first probe and said second probe are respectively created along mutually perpendicular first and second axis lines, which both pass through a cross point of said wiring board and the longitudinal axis of said waveguide; and a first center line passing through the middle of each transversal line segment of said first probe is shifted from said first axis line and a second center line passing through the middle of each transversal line segment of said second probe is shifted from said second axis line in such a way that, on said wiring board, said first probe is farther separated away from said second probe.

6. A satellite-broadcasting reception antenna comprising:

a reflecting mirror for reflecting an electromagnetic wave transmitted by a satellite; and a microwave reception converter which is used for taking in said electromagnetic wave reflected by said reflecting mirror and down-converting the frequency of said electromagnetic wave into a predetermined frequency band and comprises:

a waveguide for transmitting said electromagnetic wave;

a wiring board brought into contact with a first side of said waveguide opposite to a second side of said waveguide for inputting said electromagnetic wave, being oriented perpendicularly to a longitudinal axis of said waveguide;

a first probe provided in an area on said wiring board inside said waveguide for taking in a first linearly polarized wave;

a second probe provided in an area on said wiring board inside said waveguide for taking in a second linearly polarized wave perpendicular to said first linearly polarized wave;

a down-converter circuit for down-converting the frequency of a signal representing said first linearly polarized wave taken in by said first probe or a signal representing said second linearly polarized wave taken in by said second probe into a predetermined frequency band;

a first amplifier for amplifying a signal representing said first linearly polarized wave taken in by said first probe and executing control to turn on and off an operation to output an amplified signal obtained as a result of amplification of said signal to said down-converter circuit; and a second amplifier for amplifying a signal representing said second linearly polarized wave taken in by said second probe and executing control to turn on and off an operation to output an amplified signal obtained as a result of amplification of said signal to said down-converter circuit, wherein:

said first probe and said second probe are created along mutually perpendicular first and second axis lines respectively, which both pass through a cross point of said wiring board and the longitudinal axis of said waveguide; and a first center line passing through the middle of each transversal line segment of said first probe is shifted from said first axis line and a second center line passing through the middle of each transversal line segment of said second probe is shifted from said second axis line in such a way that, on said wiring board, said first probe is farther separated away from said second probe.

* * * * *